US006413166B1

(12) United States Patent
Long

(10) Patent No.: US 6,413,166 B1
(45) Date of Patent: Jul. 2, 2002

(54) PUTTING GREEN SIMULATOR

(76) Inventor: Robin Michael Long, 12 Athol Rowan Way, Bedfordview, 2007 (ZA)

( * ) Notice: Subject to any disclaimer, the term of this patent is extended or adjusted under 35 U.S.C. 154(b) by 0 days.

(21) Appl. No.: 09/509,782

(22) PCT Filed: Oct. 14, 1998

(86) PCT No.: PCT/GB98/03082

§ 371 (c)(1),
(2), (4) Date: May 18, 2000

(87) PCT Pub. No.: WO99/19032

PCT Pub. Date: Apr. 22, 1999

(30) Foreign Application Priority Data

Oct. 14, 1997 (ZA) ..... 97/9182
Nov. 6, 1997 (ZA) ..... 97/9990

(51) Int. Cl.[7] ..... A63B 69/36
(52) U.S. Cl. ..... 473/160
(58) Field of Search ..... 473/160–162, 473/197

(56) References Cited

U.S. PATENT DOCUMENTS 3,690,673 A 9/1972 Occhipinti ..... 273/176 H
3,735,988 A 5/1973 Palmer et al. ..... 273/178 B
3,892,412 A 7/1975 Koo ..... 273/176 H
4,978,127 A 12/1990 Juel, Jr. ..... 273/176 H
5,203,566 A 4/1993 Ricigliano ..... 273/176 E
5,409,230 A * 4/1995 Dunaway et al. ..... 473/197
5,441,265 A 8/1995 Codlin ..... 273/176 H
5,655,971 A 8/1997 Wayne ..... 473/160
5,749,789 A * 5/1998 Karl ..... 473/162
6,152,830 A * 11/2000 Archie ..... 473/160

FOREIGN PATENT DOCUMENTS

GB 2 072 022 9/1981

* cited by examiner

*Primary Examiner*—Mark S. Graham
(74) *Attorney, Agent, or Firm*—Kenyon & Kenyon

(57) ABSTRACT

A putting green simulator consists of an inflatable body, an upper putting layer which is arranged to distort under pressure when inflated, an artificial turf layer attached or attachable to the upper putting layer so as to define a putting surface over which a golf ball may be putted, and at least one golf ball receiving cup or aperture defined in the putting surface. The arrangement is such that distortion of the upper putting layer causes contours in the putting surface so as to simulate the contours of a conventional putting green. The artificial turf layer is provided as interchangeable synthetic mats or carpets corresponding to a range of putting speeds as measured by a conventional stimp meter.

13 Claims, 2 Drawing Sheets

PUTTING GREEN SIMULATOR

BACKGROUND OF THE INVENTION

This invention relates to a putting green simulator.

Like many other sporting disciplines, golf demands a great deal of practice to become proficient at the various aspects thereof. One of the most important and indeed difficult aspects of golf is the art of putting. Although practice facilities are sometimes available, they are not always conveniently situated or readily accessible. In addition, weather conditions are not always suitable for outdoors practicing.

Various putting aids and systems are known for assisting a golfer in mastering the finer points in putting a golf ball in the comfort of his or her home or office. One such system consists of a putting track which has an inclined putting surface and a ball receiving cup at a distil end of the track. The golfer putts the golf ball up the slope towards the cup during a putting stroke. Although this system allows a golfer to practice putting a golf ball, the golfer is limited to putting the ball in a straight line due to the flat or planar nature of the putting surface. In addition, this system and similar aids are generally solid structures which tend to be cumbersome and not easy to store when not in use.

SUMMARY OF THE INVENTION

According to the invention there is provided a putting green simulator comprising:

a) an inflatable body comprising a pair of opposed, spaced apart sheets of resilient plastics material operatively defining an upper putting layer and a base, a peripheral side wall extending between the opposed peripheral edges of the upper putting layer and the base to define a sealed chamber, at least one valve arrangement for inflating and deflating the sealed chamber, and distortion means arranged to distort the upper layer under pressure when inflated;

b) an artificial turf layer attached or attachable to the upper putting layer so as to define a putting surface over which a golf ball may be putted; and c) at least one golf ball receiving cup or aperture defined in the putting surface, the arrangement being such that distortion of the upper putting layer causes contours in the putting surface so as to simulate the contours of a conventional putting green.

The distortion means preferably comprises a plurality of restraints extending at predetermined locations between the upper putting layer and the base thereby restraining portions of the upper layer under pressure to cause distortion thereof.

The restraints are preferably internal walls that divide the chamber into an array of compartments.

In one version of the invention, the array of compartments are discrete compartments, each compartment being provided with a separate valve arrangement so that the discrete compartments can be inflated to different pressures to vary the contouring of the putting surface.

In an alternate version, the internal walls include apertures so that the compartments are in air communication with one another, a single valve arrangement being provided for inflating the chamber.

The internal walls are preferably formed of a resilient plastics material.

The heights and/or thickness of the walls may be varied to further enhance the contouring of the putting surface.

The artificial turf layer is preferably formed from a mat of fibrous material, typically comprising a foam rubber layer and a layer of synthetic fibres extending therefrom.

The fibrous material is preferably adapted so that the putting surface is provided with a predetermined putting speed when measured by a conventional stimp meter.

The density of the fibrous material and/or the length of the individual fibres are preferably selected in accordance with the predetermined putting speed.

In a preferred version of the invention, a plurality of interchangeable artificial turf layers are provided, each artificial turf layer corresponding to a different putting speed.

Preferably, a plurality of ball receiving cups or apertures are defined in the putting surface, a number of inserts or plugs corresponding to the ball receiving cups or apertures being provided to plug those cups or apertures not in use.

A foot board or plate is preferably provided for a user to stand on whilst practicing a putting stroke.

The foot board is preferably located adjacent the inflatable body so that the artificial turf covers both the inflatable body and the foot board to provide a continuous putting surface.

The base is typically provided with a plurality of parallel strengthening rods or ribs to strengthen the inflatable body against buckling or bulging upon inflation whilst allowing it to be rolled up when deflated and not in use.

Connector means are preferably provided at or adjacent the peripheral side wall so that two or more putting green simulators can be connected together to provide an enlarged putting surface.

BRIEF DESCRIPTION OF THE DRAWINGS

The invention will now be described in more detail, by way of example only, with reference to the accompanying drawings in which.

DESCRIPTION OF PREFERRED EMBODIMENTS

Figure 1A:
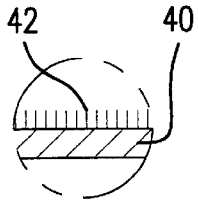
FIG. 1 is an exploded perspective view of a putting green simulator of the invention.
Figure 1:
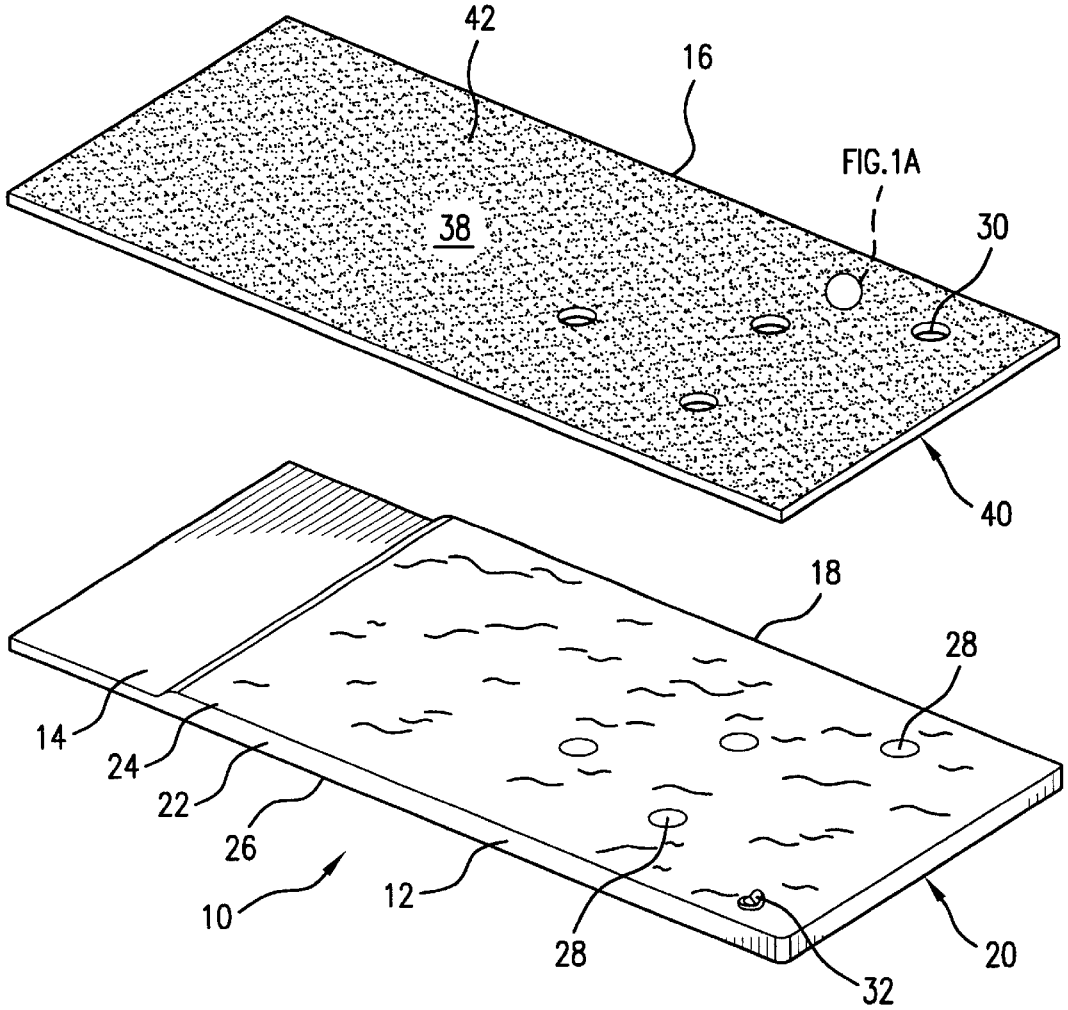

Referring, to FIG. 1, there is shown a putting green simulator 10 consisting of an inflatable body 12, a foot plate or board 14 and a layer of artificial turf 16 that covers the inflatable body 12 and the foot plate 14.

The inflatable body 12 consists of a pair of opposed sheets formed from polyvinylchloride (PVC) which operatively define an upper putting layer or wall 18 and a base 20. The putting layer 18 and base 20 are separated by a peripheral wall 22 which may be welded to their respective peripheral edges 24 and 26 or formed as a unitary construction with them. Although made from PVC in this case, the inflatable body may be formed from any suitable, preferably elastomeric, material such as a synthetic rubber, plastics material or a combination thereof, for example.

The inflatable body 12 includes a number of ball receiving cups or apertures 28 into which a golf ball can be putted during a putting stroke. Corresponding apertures 30 extend through the layer of artificial turf 16. A number of inserts or plugs (not shown) are provided for plugging one or more of the cups 28 and apertures 30 when they are not required so that a continuous putting surface is provided. A valve arrangement 32 is provided for inflating the body 12.

Figure 2:
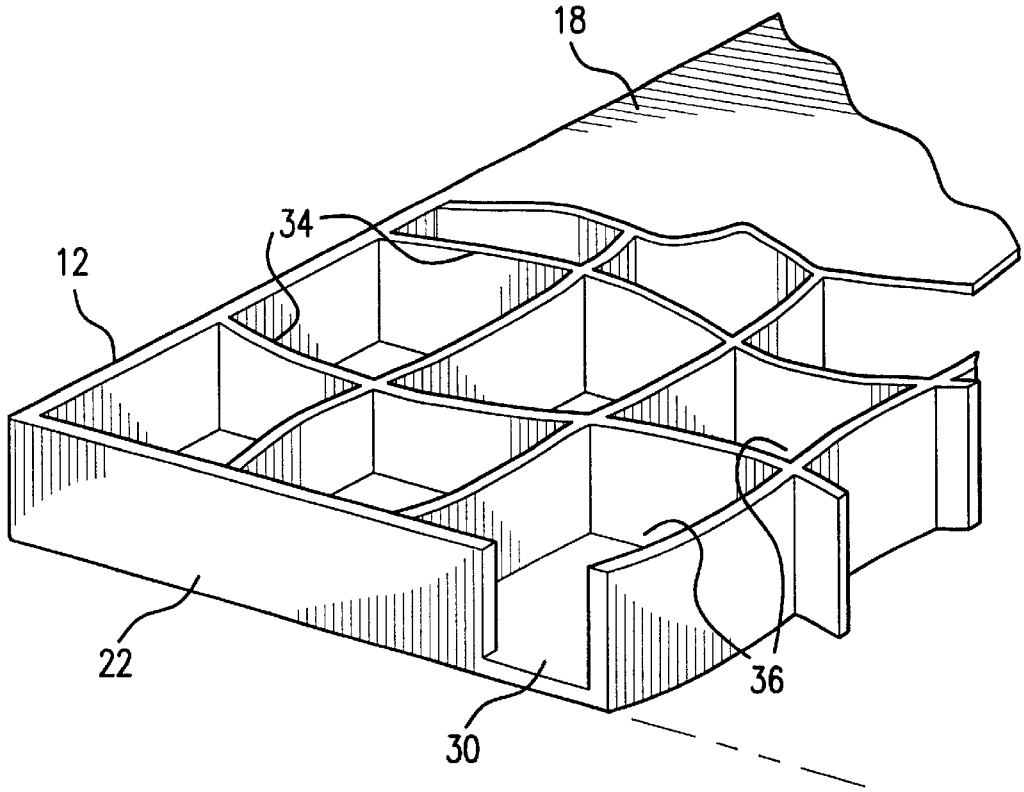
FIG. 2 is a perspective view of a corner of the simulator of FIG. 1 partially cut away.

Referring to FIG. 2, which shows a cut-away portion of a corner of the inflatable body 12, distortion means or restraints in the form of resilient ribs or internal partition walls 34 divide the inflatable body 12 into a number of compartments 36. The ribs 34 extend between the upper wall 18 and the base 20 so as to restrict the movement of those portions of the upper wall 18 attached to the ribs 34 away from the base 20 upon inflation. The effect of this restriction in movement causes distortion of the upper wall 18 which in turn causes contours to form in the artificial turf layer 16. Instead of using the ribs 34, other restraints such as, for example, remote chords or straps arranged between the wall 18 and base 20 can also be used. Alternatively, the thickness of the wall 18 can be varied to provide distortions under pressure.

The ribs 34 are also formed from PVC, although any other appropriate elastomeric material, typically the same material as the rest of the inflatable body 12, can be used. The height and thickness of the respective ribs 34 are varied to further enhance the. contours in the artificial turf layer 16. Although a fairly dense network of ribs 34 is shown in FIG. 2, the number and configuration of these ribs can be varied to suit the end product requirements.

In addition, it is envisaged that the compartments 36, or sets of the compartments 36, can either be in air communication with one another or discrete. Where they are discrete, they can be inflated to different pressures, allowing the user the further opportunity of varying the contours and slopes of the artificial turf layer 16. In this latter case, additional valves are required to inflate the various compartments 36.

An important feature of the invention is the nature of the artificial turf layer 16. This turf layer 16 defines a putting surface 38 which is selected so as to correspond to a particular putting speed when measured by a conventional stimp meter. The artificial turf layer 16, in the form of a mat or carpet of fibrous material, consists of a backing layer 40 formed of a flexible foam rubber material and a layer of synthetic fibres 42 extending from the backing layer 40. In this case the synthetic fibres are formed of polypropylene, although any other suitable material may be used. With the use of special equipment for "spraying" the fibres on to the backing layer 40, the nature of the putting surface 38 can be tailored to a particular putting speed. For instance, the density of the fibres may be varied resulting in varied putting speeds. Likewise, the length of the individual fibres, which typically ranges from 2 to 5 mm, can also be varied to provide a desired putting speed. Further, a section of the artificial layer may be provided with a denser mat than the remainder of the layer 16 thereby simulating the texture of a conventional putting green and surrounding fringe.

In one embodiment of the invention, the artificial turf layer 16 is attached or adhered to the putting layer 18. In an alternative embodiment of the invention, the artificial turf layer 16 is attachable to the layer 18 via suitable attachment means (not shown) such as hook and loop fasteners, for example. An advantage of this latter embodiment is that a number of artificial layers 16 may be provided with the inflatable body 12 in kit form thus allowing a user flexibility to interchange the artificial layer 16 and thereby practice putting over a range of putting speeds.

The foam backing layer 40 is selected so that it will follow the distortions of the wall 18 to provide contours in the putting surface 38. If desired, the density of this foam layer 18 can be varied in order to temper the contouring caused by distortion of the layer 18. This is an important aspect as conventional putting greens often only have very subtle contours or slopes. Accordingly, it is preferable to ensure that the putting surface 38 likewise has subtle contours in certain circumstances.

Although a foot plate 14 is provided in this case, it is not essential. If the foot plate 14 is not provided, the depth of the body 12 must not be too great to ensure that the putting surface 38 is not too far above the surface on which the user stands. (It is preferable that the user does not stand on the inflatable body 12 to reduce the risk of puncturing it). The depth of the body 12 can, however, vary according to the end use requirements. It will typically range from between about 10 mm to about 200 mm when inflated.

The remaining dimensions of the simulator are likewise variable. The body 12 can even be formed in such a manner that, in addition to the contours, the putting surface 38 is inclined in one or more directions for providing additional slopes. Although the inflatable 12 is rectangular in this case, any applicable or desirable shape may be provided.

Figure 3:
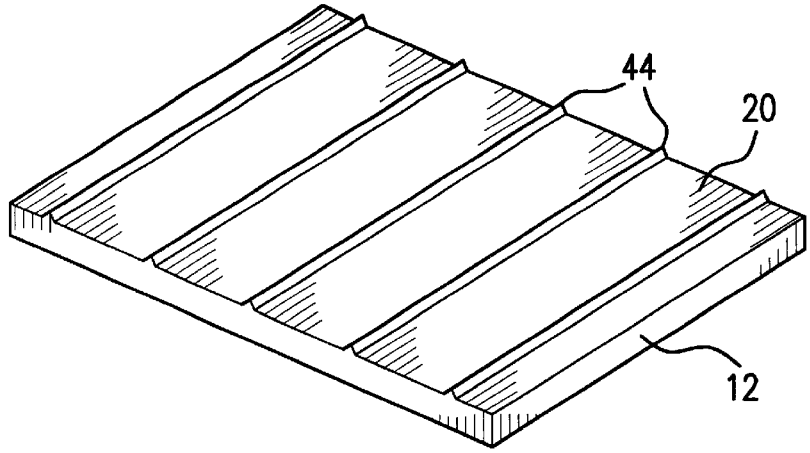
FIG. 3 is a perspective view of the underside of the putting green simulator of FIG. 1.

Turning to FIG. 3, the base 20 is provided with a number of ribs or reinforcing rods 44. These are intended to prevent, to a certain extent at least, buckling or bulging of the inflatable body 12 when fully inflated. They are provided across the width of the base 20, only, to allow the inflatable body 12 to be rolled up when not inflated. A number of connectors (not shown) can be provided so as to connect more than one simulator together to increase the size of the putting surface.

The putting green simulator of the invention is believed to provide a number of advantages over conventional systems. Because the putting surface is contoured and can be adapted to correspond to a range of putting speeds, it simulates the surface of a conventional putting green and thereby provides the golfer with a useful alternative to conventional contoured and sloped greens. In addition, because the simulator is inflatable, it can be deflated and stored in a relatively mall storage space. Further, a number of simulators can be connected to one another to form a much larger artificial putting green. By varying position of the different simulators, the nature of the artificial putting green can be adjusted to suit the requirements of the user.

What is claimed is:

1. A putting green simulator comprising a) an inflatable body comprising a pair of opposed sheets of resilient plastics material operatively defining an upper putting layer and a base, a peripheral side wall extending between the opposed peripheral edges of the upper putting layer and the base to define a sealed chamber, at least one valve arrangement for inflating and deflating the sealed chamber, at least one ball receiving cup formation extending into or through the inflatable body, and a network of internal walls located between the upper putting layer and the base so as to space the upper putting layer from the base and to divide the chamber into an array of compartments, the internal walls being attached, at least partially, along their respective upper and lower edges to the upper putting layer and base, respectively, so as to distort the upper putting layer under pressure when inflated;

b) an artificial turf layer attached or attachable to the upper putting layer so as to define a putting surface over which a golf ball may be putted; and c) at least one golf ball receiving aperture defined in the putting surface to correspond to the at least one ball receiving cup formation, such that distortion of the upper putting layer causes contours in the putting surface so as to simulate the contours of a conventional putting green.

2. A putting green simulator according to claim 1, wherein the array of compartments are discrete compartments, each compartment being provided with a separate valve arrangement so that the discrete compartments can be inflated to different pressures to vary the contouring of the putting surface.

3. A putting green simulator according to claim 1, wherein the internal walls include apertures so that the compartments are in air communication with one another, a single valve arrangement being provided for inflating the chamber.

4. A putting green simulator according to claim 1, wherein the internal walls are formed of a resilient plastics material.

5. A putting green simulator according to claim 1, wherein the internal walls have different heights and/or thicknesses to further enhance the contouring of the putting surface.

6. A putting green simulator according to claim 1, wherein the artificial turf layer comprises a foam rubber layer and a layer of synthetic fibres extending therefrom, and wherein the layer of synthetic fibres is selected or formed in such a manner that the putting surface has a desired putting speed, as measured by a conventional stimp meter, corresponding to a particular putting speed of a conventional putting green that is being simulated.

7. A putting green simulator according to claim 6, wherein the density of the layer of synthetic fibres and/or the length of the individual fibres are selected so as to provide the desired putting speed.

8. A putting green simulator according to claim 1, wherein a plurality of interchangeable artificial turf layers are provided, each artificial turf layer having a desired putting speed corresponding to the particular putting speed of respective conventional putting greens.

9. A putting green simulator according to claim 1, wherein a plurality of ball receiving cups or apertures are defined in the putting surface, a number of inserts or plugs corresponding to the ball receiving cups or apertures being provided to plug those cups or apertures not in use.

10. A putting green simulator according to claim 1, further comprising a foot board or plate for a user to stand on whilst practicing a putting stroke.

11. A putting green simulator according to claim 10, wherein the foot board is located adjacent the inflatable body and the artificial turf covers both the inflatable body and the foot board to provide a continuous putting surface.

12. A putting green simulator according to claim 1, wherein the base is provided with a plurality of parallel strengthening rods or ribs to strengthen the inflatable body against buckling or bulging upon inflation whilst allowing it to be rolled up when deflated and not in use.

13. A putting green simulator according to claim 1, wherein the simulator includes connector means at or adjacent the peripheral side wall so that two or more putting green simulators can be connected together to provide an enlarged putting surface.

* * * * *